United States Patent [19]

Kenzelmann et al.

[11] Patent Number: 4,819,379

[45] Date of Patent: Apr. 11, 1989

[54] ELECTROMAGNETIC GARAGE DOOR LOCKING APPARATUS

[75] Inventors: Joseph E. Kenzelmann; Frederick J. Kenzelmann, both of Huntington Beach, Calif.

[73] Assignee: Automatic Electrolock, Inc., Huntington Beach, Calif.

[21] Appl. No.: 22,752

[22] Filed: Mar. 6, 1987

[51] Int. Cl.[4] ..... E05F 15/00

[52] U.S. Cl. ..... 49/280; 49/199

[58] Field of Search ..... 49/199, 280; 200/61.67

[56] References Cited

U.S. PATENT DOCUMENTS

| | | | |
|---|---|---|---|
| 2,742,280 | 4/1956 | Wilcox | 160/189 |
| 2,859,960 | 11/1958 | Magondeaux | 49/25 |
| 3,224,493 | 12/1965 | Houk | 49/280 X |
| 3,319,696 | 5/1967 | Wiegand | 49/199 X |
| 3,444,344 | 5/1969 | Purdy | 200/153 |
| 3,548,619 | 12/1970 | Purdy | 70/267 |
| 3,584,912 | 6/1971 | Leger | 49/280 X |
| 3,708,917 | 1/1973 | Streeter | 49/199 X |
| 3,782,034 | 1/1974 | Lynn et al. | 49/280 X |
| 3,996,591 | 12/1976 | Hayward | 343/225 |
| 4,254,582 | 3/1981 | McGee | 49/199 |
| 4,442,631 | 4/1984 | Weber | 49/199 |

*Primary Examiner*—Philip O. Kannan

*Attorney, Agent, or Firm*—Knobbe, Martens, Olson & Bear

[57] ABSTRACT

A locking apparatus for an electrically actuated garage door opener assembly is disclosed for preventing the unauthorized entry into a home or building. The locking apparatus comprises an electric solenoid and associated plunger and is electrically connected to the electrically actuated garage door opener in order to selective lock and unlock the garage door. In the deactivated condition of the opener, the plunger provides a locking mechanism. When the opener is activated, the solenoid is energized and the plunger is withdrawn from its locking position, thus permitting the door to open. An important feature of the present invention is a sensing mechanism which senses the locked and unlocked position of the solenoid plunger. If the plunger is in the locked position, the sensor will prevent actuation of the opener, thereby avoiding damage to the door or opener.

13 Claims, 2 Drawing Sheets

Fig. 1
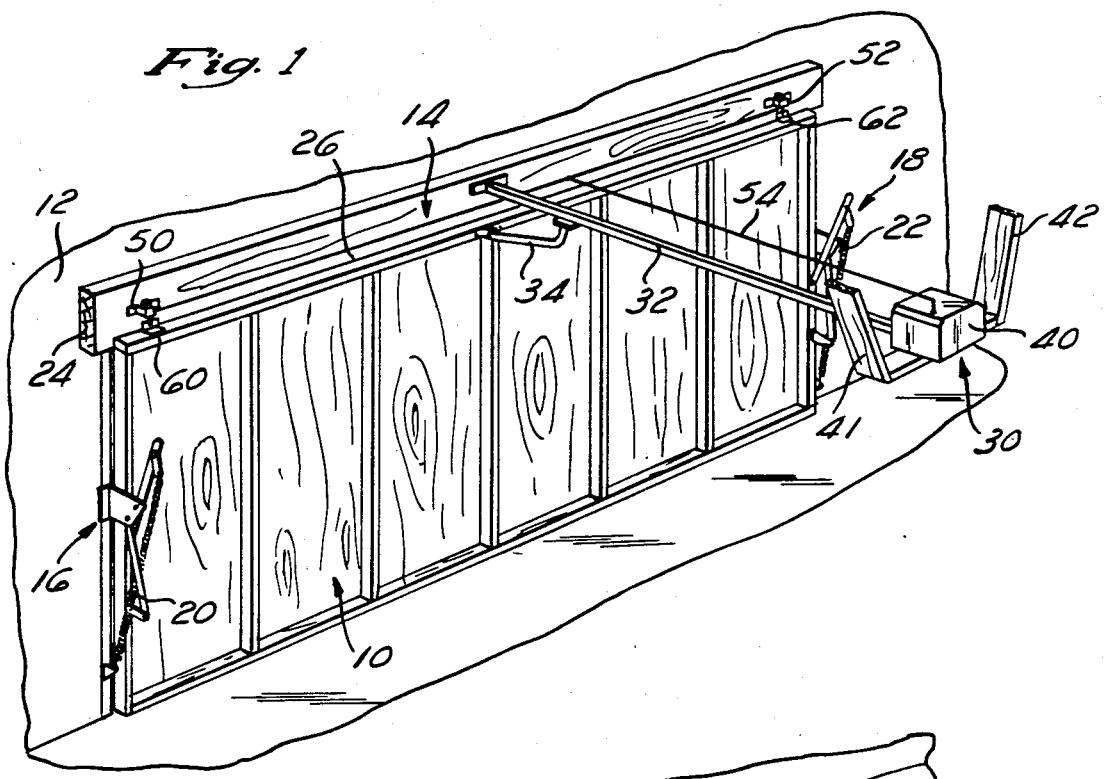
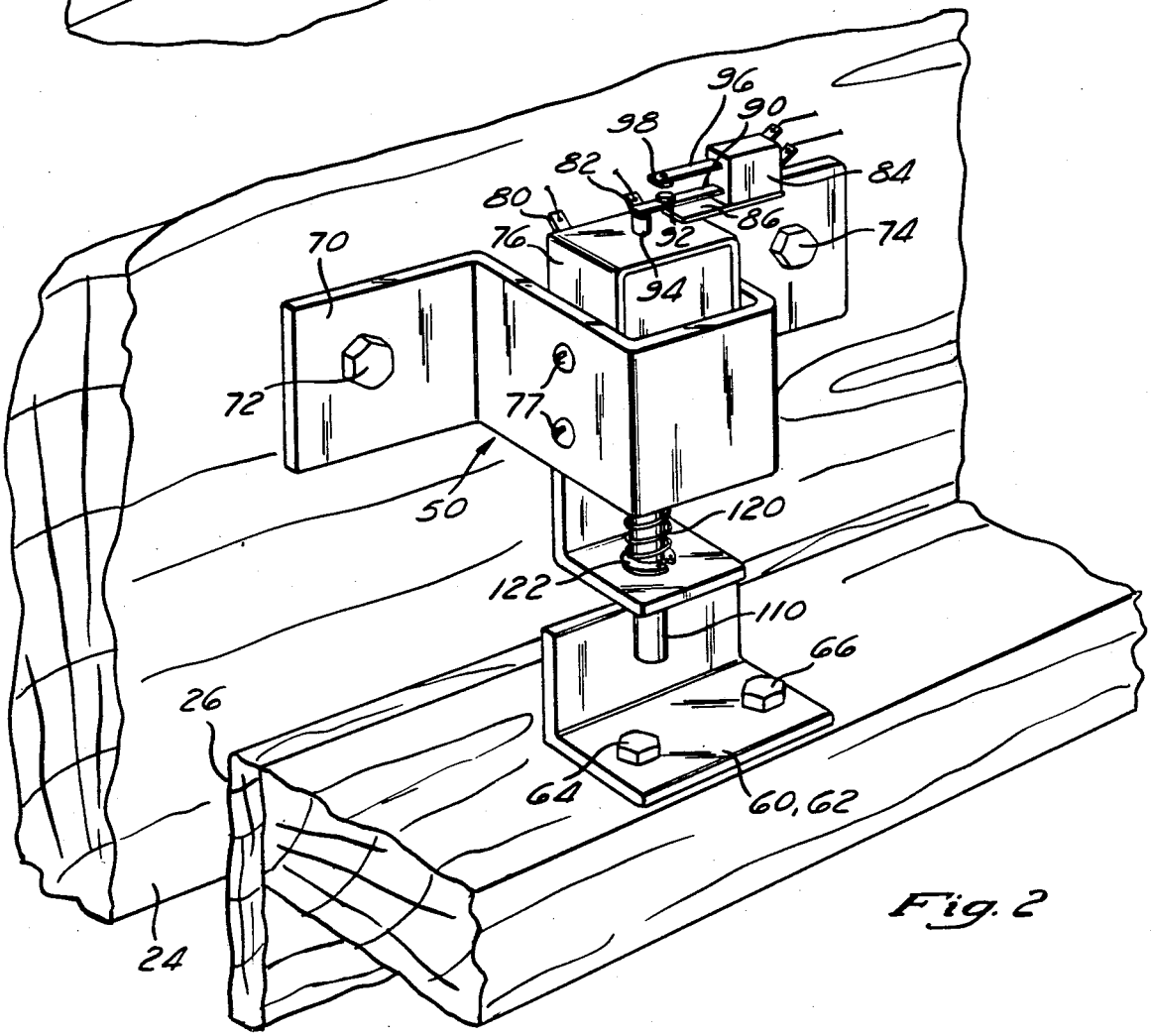
Fig. 2

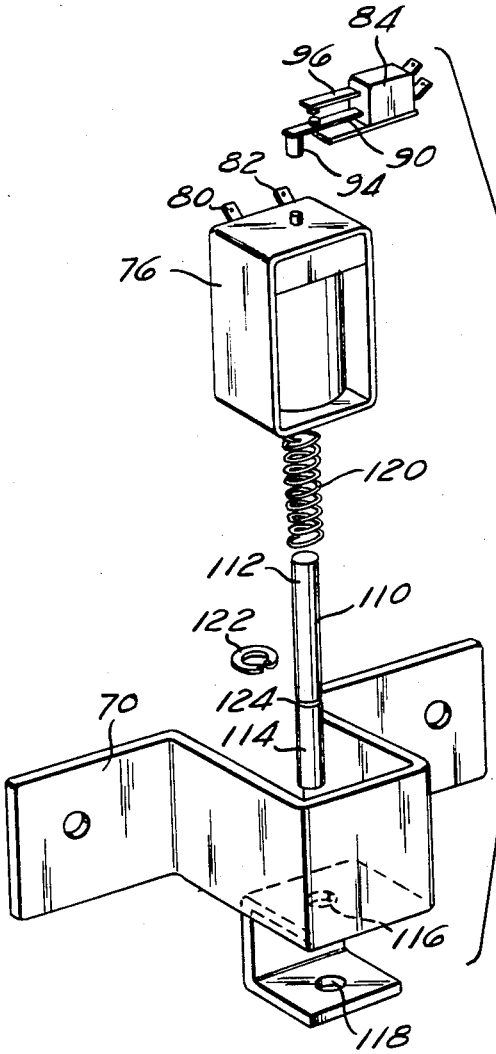
Fig. 3
Fig. 4
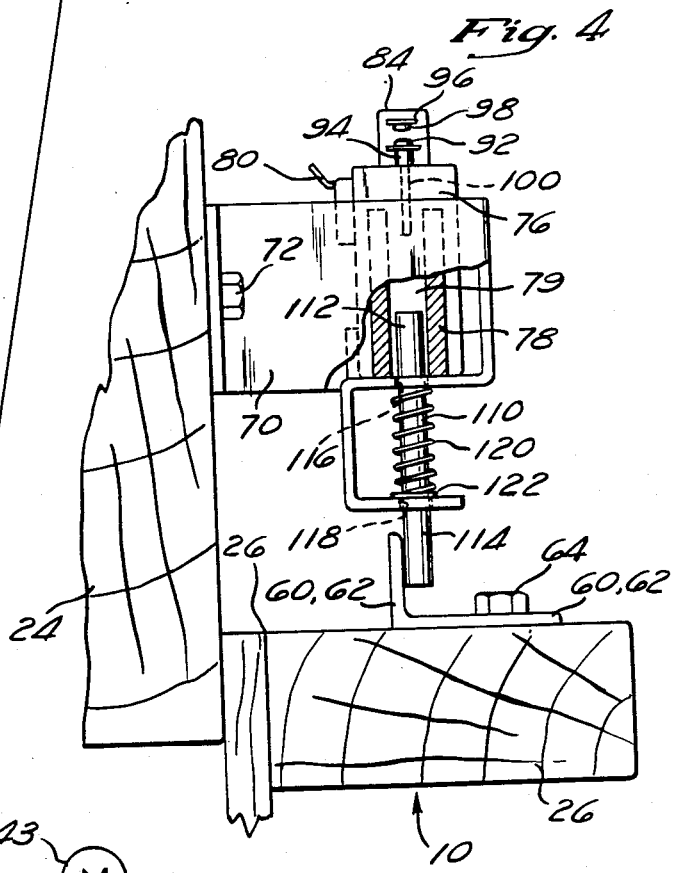
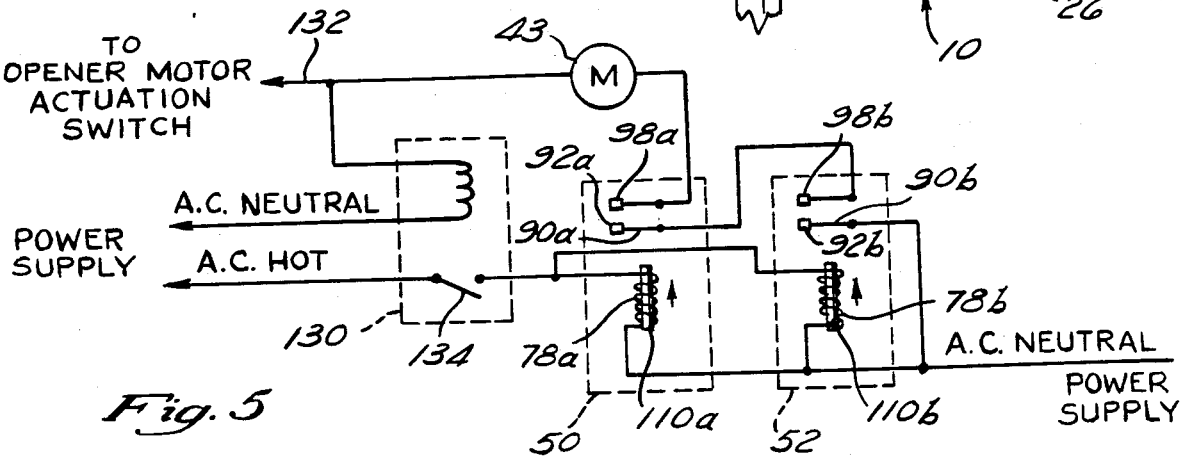
Fig. 5

ELECTROMAGNETIC GARAGE DOOR LOCKING APPARATUS

BACKGROUND OF THE INVENTION

The present invention relates to an electrically actuated door opener assembly, and more particularly, to a positive locking mechanism for overhead garage doors that automatically engages to provide greater security against unauthorized entry through the door in the closed position.

The overhead garage door assembly of the type in wide use typically includes a solid door pivotally mounted in a door frame so that, from the closed position, the door can move pivotally upwardly and rearwardly to an overhead, approximately horizontal position. The assembly also typically includes a remotely controlled mechanism to automatically open and close the door upon command. These automatic garage door openers are of at least four basic types:(1) the frictional engagement form; (2) the rack and pinion form; (3) the chain drive form; and (4) the plastic track drive.

With the frictional engagement form, resilient rollers of the opener frictionally engage a member connected to and extending from the garage door. The force to open and close the garage door is applied by the opener motor to the rollers whose frictional engagement with the extended member causes the door to open and close.

In the rack and pinion type, a rotatable pinion is connected through a guide track to a receiving bracket, which, in turn, is connected to the garage door so that the door may be opened and closed by rotational movement of the pinion.

The chain drive type of automatic garage door opener is exemplified by a commercially available garage door opener manufactured by Genie Home Products, Inc., including models SP-229, SP-129, SP-99 and CH-130. A chain loop is connected to a sprocket on the opener motor at one end of a track, and at the other end of the track the chain is connected to a freely moving sprocket. The chain is also directly connected to the garage door by, for example, an L-shaped bracket so that as the opener motor rotates, the chain rotates with it, moving the L-shaped bracket and thereby moving the door. As an additional feature, the opener motor may rotate in either direction so that the door may be either open or closed upon command.

All types of automatic garage door openers may be subject to unauthorized entry. For example, the frictional type may be forced open by application of sufficient force to the lower portion of the door to overcome the normal frictional bond between the resilient rollers and the extending member, which can create an access opening under the garage door. Using the rack and pinion type as another example, a sufficient force applied to the bottom of the door may cause the receiving bracket to back up along the pinion and thereby also create an access opening under the door. Similarly, the chain drive type of garage door opener is subject to unauthorized entry. For example, the chain may have sufficient "free play" to enable an intruder to slip under a garage door, or the intruder may be able to apply sufficient force to rotate the chain enough to create an access opening under the door.

Regardless of the type of overhead garage door opener, the garage door inherently has some amount of flexibility. The intruder, using this flexibility to his beneift, and possibly in combination with one of the above-described deficiencies of the automatic openers, may be able to pry open a corner and slip through the access opening created thereby.

The overhead garage door assembly and its susceptibility to unauthorized entry is discussed at length and in greater detail in the U.S. Pat. No. 4,254,582 issued to Michael H. McGee. The apparatus described in the McGee patent includes a positive locking mechanism that prevents a person attempting unauthorized entry from forcing reverse movement of the opener. This locking mechanism includes two solenoids secured to the interior of the door frame, two latch members (one for each solenoid) secured on the interior of the garage door. The latch members receive a solenoid plunger when the door is in the closed position and the solenoid is not electrically actuated. Preferably, the solenoid is actuated by a signal from the conventional controls for the garage door opener so that when the opener is electrically actuated, it causes simultaneous actuation of the solenoids to withdraw their plungers from the latch members and release the door for movement from, or movement back, into its closed position. However, the McGee apparatus utilizes a separate power supply which operates independently from the power supply of the garage door opener.

A significant problem with the apparatus described in the McGee patent arises when at least one of the solenoid plungers remains received within its latch member after actuation of opener motor. This condition, wherein the garage door is prevented from movement, may have been caused by one of many reasons, including a failure of the solenoid, a loose electrical connection, or even a mechanical jamming of the plunger within the latch member. In such an instance, the actuated opener motor may continue attempting to open the garage door while the solenoid and latch simultaneously restrain the door in the closed position. This unfavorable situation may result in damage to any of the various components of the garage door assembly, including the expensive possibility of burning the motor windings beyond repair. Alternatively, this situation may result in other types of damage, including the possibility that the solenoid assembly and the associated electrical wires could be torn or pulled from their affixed positions, causing damage to the door and door frame as well as the potential of personal injury from inadvertent contact with a loose or dangling electrical connection, or, at the instant of breakage, from being hit by flying objects such as broken pieces of the splintered door and associated apparatus.

BRIEF SUMMARY OF THE INVENTION

The present invention provides an apparatus for electromagnetically locking a garage door in the closed position for the purpose of substantially preventing attempts at unauthorized entry through the garage door. The present invention detects the locked and unlocked positions of the solenoid plunger so that the opener motor cannot operate while the door is locked, thereby precluding the possibility of damage that could be caused if the opener attempted to open the door in the locked configuration. To assure proper operation of the opener, the motor becomes operational only when the invention detects that the door has been electromagnetically unlocked.

In a preferred embodiment of the present invention, the electromagnetic lock includes two solenoid assemblies, one affixed at each end of the upper door frame of an overhead garage door assembly. Two latch members are secured to the garage door proximate to each respective solenoid assembly so that the solenoid plunger of each assembly may be received therein and thereby lock the door in the closed position. Preferably, the solenoids are actuated by the opener assembly, so that when the control button is pushed by the operator, electrical power is immediately supplied to the solenoid, thereby causing a withdrawal of the solenoid plunger toward the unlocked position. When the plunger has been withdrawn to the unlocked position, a switch is actuated by the plunger which, in turn, electrically actuates the opener motor. The circuit including the opener motor, prior to such unlocking, is an open circuit. Thus, the opener motor becomes operational only when the solenoid plunger is, in fact, in the unlocked position.

Furthermore, in a preferred embodiment, each latch member is affixed to the opposite top edges of the garage door. The solenoid assemblies are accordingly affixed to the upper corner of the door frame so that there is a very close clearance between the garage door and the door frame, substantially precluding attempts at unauthorized direct manipulation of the solenoid plungers by would-be intruders.

These and other advantages and features of the present invention will become more fully apparent from the following description and appended claims taken in conjunction with the accompanying drawings.

BRIEF DESCRIPTION OF THE DRAWINGS

FIG. 1 is an inner perspective view of a typical garage door assembly having an electrically actuated garage door opener installed, the garage door being shown in the closed position.

FIG. 2 is a close-up perspective view of a solenoid assembly and a latch of the present invention in locking engagement, the solenoid assembly being installed on the garage door frame, and the latch member being installed on the upper edge of the garage door.

FIG. 3 is an exploded view of the solenoid assembly of the present invention, showing a switch, a solenoid housing, a spring, a plunger, a stop clip on the plunger, and a bracket.

FIG. 4 is a side view of the solenoid assembly and latch of FIG. 2, with a partial cross-sectional view of the solenoid housing, showing the solenoid core and a pin for actuating the switch.

FIG. 5 is a circuit diagram of the preferred embodiment of the present invention.

DETAILED DESCRIPTION OF THE PREFERRED EMBODIMENT

The present invention relates to an electrically actuated overhead garage door opener assembly and, more specifically, to an improved solenoid mechanism, safely and easily operable, for providing more secure retainment and locking of the garage door in its closed position. The present invention is illustrated in the following description integrated with a particular common form of overhead garage door opener installed for opening and closing a particular common form of garage door, the door being a solid or single-piece assembly. However, it should be understood that the principles of the present invention are equally applicable to virtually any form of overhead garage door and any form of overhead garage door opener assembly, and therefore, it is not intended to limit the principles of the present invention to the specific embodiment shown and such principles should be broadly construed.

Referring now to FIG. 1, an overhead garage door is generally indicated at 10, the door being of the solid type. The door 10 is mounted on the front wall 12 of a typical garage, within the opening defined generally by door frame 14. The door 10 may be mounted on the frame 14 in any known manner, advantageously by mounting each side of the door 10 to the standard pivoting side lever assemblies indicated generally at 16 and 18, which are mounted on opposite sides of the garage door frame 14, and includes counterbalancing springs 20, 22. As a result, garage door 10 may be moved from the generally vertical closed position shown in FIG. 1, pivotally upwardly to an overhead, nearly horizontal position (not shown), thereby permitting free passage through the door frame into the garage. It should be noted that, in the closed position illustrated in FIG. 1, upper frame surface 24 proximate to its lower edge makes contact with an upper edge 26 of door 10.

A selectively electrically actuable garage door opener assembly is generally indicated at 30. Such assemblies are in wide use and are available from many manufacturers, and the present invention can be used with any of these as well as the particular assembly described herein. The assembly 30 described herein is similar to that available commercially from Genie Home Products, Inc., such as models SP-129, SP-229, SP-99, and CH-130. The assembly 30 includes a guide track 32 mounted on upper frame surface 14, having a chain (not shown) rotatable about its length, an opener arm 34 slideably connected with guide track 32 and also affixed to the chain. The opener assembly 30 also includes a motor assembly box 40 having a built-in control unit (not shown) affixed to the end of guide track 32 opposite door frame surface 14 and also structurally connected to the garage door ceiling (not shown) by members 41, 42. An opener motor 43 (shown in FIG. 5) within motor assembly box 40 engages the chain, and furthermore is responsive to the built-in control unit. As a result, an acutation of the opener motor 43 moves the chain, which rotates about the guide track 32, thereby moving the opener arm 34 and finally moving the garage door 10. The opener motor 43 is actuable in either direction of rotation, so that the door 10 may be alternately opened or closed.

The built-in control unit is operably connected to the opener motor, and is also connected to a button switch (not shown), which is provided with any of the above-described products of Genie Home Products, Inc. Pressing the button switch selectively actuates opening or closing of the garage door. However, the opener motor may be actuated in any known manner, for example, by a remote control sensing device (not shown) available with the above-specified product of Genie Home Products, Inc. The motor assembly box 40 is electrically connected to a suitable electric power supply (not shown) such as 110 v.a.c. household circuit, to supply the necessary electrical power to operate the various circuits, including the opener motor.

Thus, as with the typical garage door assembly, with the garage door 10 in the closed position as shown in FIG. 1, the opener motor may be actuated to move the opener arm 34 rearwardly along guide track 32, carrying the garage door upwardly and rearwardly in pivotal motion to the overhead open position where the opener automatically stops. A subsequent actuation may reversely actuate the opener motor, so that the opener arm 34 moves forwardly, pivotally moving the garage door towards the closed position.

In view of the prevalency of crime, and particularly burglaries in modern times, one of the principal problems encountered by owners of conventional garage door assemblies such as that described above, has been unauthorized attempts to open the garage door without electrical actuation. Unfortunately, many such attempts have been successful, as previously discussed in greater detail in the Background of the Invention.

Therefore, in order to more securely retain the garage door 10 in its closed position, the present invention provides electrically actuated solenoid assemblies 50, 52 mounted on each opposite upper corner of the upper frame surface 24. In FIG. 1, the solenoid assembly 50 is shown affixed on the upper left hand corner of door frame 14, and solenoid assembly 52 is affixed to the upper right hand corner of door frame 14. For each solenoid assembly 50, 52, there is a corresponding L-shaped latch member 60, 62 affixed to upper edge 26 to engage with the respective solenoid assembly 50, 52 in the "locked" position shown in FIGS. 1 and 2. The various electrical connections between the solenoid assemblies 50, 52 and the motor assembly box 40 are shown generally by line 54. Furthermore, latch members 60, 62 are so aligned that when the respective solenoid assembly plunger 110 is withdrawn into the assembly, each latch member 60, 62 is not engaged, and therefore, the garage door 10 is free to move. Latch members 60, 62 may be affixed to door 10 in any well-known means, advantageously by securing screws 64, 66.

Referring now to FIGS. 2, 3 and 4, each solenoid assembly 50, 52 is constructed substantially the same; thus, reference is made to only one such assembly 50. The assembly 50 includes a bracket 70 affixed to upper frame surface 24 in any well-known manner, advantageously by utilizing bracket mounting bolts 72 and 74. A solenoid housing 76 is affixed to bracket 70 in any well-known manner, advantageously utilizing mounting screws 77 to affix the housing 76 to bracket 70. Within solenoid housing 76, a solenoid core 78 (shown in FIG. 4) is electrically connected to two leads, arbitrarily labeled solenoid AC hot lead 80 and solenoid AC neutral lead 82, the solenoid core 78 defining cylindrical cavity 79 (as shown in FIG. 4). On the upper portion of solenoid housing 76, a switch assembly generally shown at 84 comprising a metallic member 86 is affixed to housing 76 in any well-known manner, advantageously by welding metallic member 86 to a portion of solenoid housing 76. Switch assembly 84 also includes a first flexible contact arm 90 having a first electrical contact 92, a pin seat 94 affixed thereon and further includes a second contact arm 96 having a second electrical contact 98 affixed thereon proximate to first contact 92. The bottom surface of the pin seat 94 resides adjacent to a pin 100 (shown in FIG. 4), the pin 100 being slideably mounted within housing 76 and projecting through the housing 76 and into cylindrical cavity 79 defined by solenoid core 78.

As illustrated in FIG. 4, the switch assembly 84 is in its deactuated position since contacts 92 and 98 are not touching one another. Thus, as explained in more detail below in connection with FIG. 5, the opener motor 43 is disabled in this position and, therefore, cannot incur any damage due to premature actuation while the locking mechanism is engaged. The motor 43 can be actuated only when the contacts 92 and 98 are engaged, and this can occur only when pin 100 has been forced upward by the movement of the plunger 110 in the solenoid core 78.

The above-described solenoid housing 76, together with switch assembly 84 is commercially available, and is substantially similar to box frame solenoid number 11S available from Guardian Electric Manufacturing Company, Chicago, Ill.

Referring now to FIGS. 3 and 4, the solenoid assembly 50 also includes a cylindrical solenoid plunger 110 comprised of a metallic material responsive to a magnetic field. The cylindrical shape is adapted to slide freely within solenoid cavity 79 so that when electrical power is applied to solenoid core 78, the plunger 110 may move responsively. The plunger 110 has a core end 112, which may move within core cavity 79, and has a locking or engagement end 114 at the opposite end, which engages latch 60 in the closed or locked position demonstrated in FIG. 4. The core end 112 preferably is provided with a non-magnetic tip so that the plunger 110 will not inadvertently be attracted to metallic objects at the upper end of the core cavity 79, and will return to the locked position shown in FIG. 4. The exploded view in FIG. 3 illustrates the plunger 110 and its relation with the surrounding structures. The plunger 110 is insertable through, and slideable with, holes defined in the bracket 70, these holes being upper plunger guide 116 and lower plunger guide 118. In other embodiments (not shown), nylon bushings may be inserted annularly within the upper and lower guides 116, 118 in order to facilitate smooth movement of the plunger within the plunger guides 116, 118.

With the plunger 110 inserted as in FIG. 4, a spring 120 is mounted surrounding the plunger 110, with one end of the spring adjacent to upper plunger guide 116 and the other end of the spring adjacent to snap clip 122, which is snapped onto plunger 110 over annular groove 124 formed on plunger 110. As a result, the plunger 110 is biased by the spring downward, away from the core and toward the locked position shown in FIG. 4. Further downward movement of plunger 110 is prevented by contact between snap clip 122 and lower plunger guide 118. Therefore, the solenoid assembly 50 remains in the locked state until electrical power is applied to the solenoid core 78. When such electrical is applied, the plunger engagement end 114 is withdrawn from its engagement with latch member 60, thereby freeing the door 10 to rotate to the open position.

As the plunger 110, responsive to the actuation of the core, is so withdrawn into the core cavity 79, the core end 112 of the plunger 110 contacts pin 100, pushing it and pin seat 94 upward, flexing the first flexible arm 90 so that first electrical contact 92 makes an electrical connection with second electrical contact 98. Only when the switch assembly 84 is in this actuated position will the opener motor 43 be energized and able to open the garage door. The distance separating the core end 112 of the plunger 110 and the pin 100 is calibrated to ensure that the locking end 114 is clear of the latch 60 before actuation of switch 84 occurs. Thus, the damage to the locking mechanism is avoided.

After deactuation of the opener motor 43 and switch 84, the plunger 110 returns to the locked position (although the latch 60 may not be present if the door 10 is open), thus permitting the pin 100 to return to the position shown in FIG. 4. This is accomplished because of the spring-like action of the flexible arm 90.

In the preferred embodiment, each solenoid assembly 50, 52 is operably connected to the electric power supply through the garage opener assembly 30 and electrical line 54 as shown in FIG. 1. At least two types of electrical connections are included in line 54: (1) connections to supply power to the solenoid core 78, and (2) connections to disable operation of the opener motor while the solenoid plungers 110 are in the locked position shown in FIG. 2.

Generally, in the preferred embodiment, the means to supply electrical power to the solenoid cores 78 comprises an electrical connection between each solenoid core 78, the opener assembly 30, and the electric power supply, so that after the garage door opener assembly 30 is actuated, as hereinbefore described, the core 78 of the solenoid assembly 50 will be actuated with electrical power with the result that the plunger 110 will move to its withdrawn position disengaged from and free of latch member 60.

However, in other embodiments (not shown) the electrical power supply and the solenoid cores 78 may be electrically connected directly through a common switch so that the solenoid assemblies 50, 52 receive electric power directly from the power supply, separate and apart from the garage door opener assembly 30, requiring separate electrical actuation of the solenoid assemblies 50, 52 and garage door assembly 30 in proper sequence.

Generally, the preferred embodiment has a means to disable operation of the opener motor which includes an electrical connection between each solenoid switch 84 and the circuit supplying power to the opener motor, so that the opener motor is operable only when each solenoid assembly 50, 52 has been actuated, and the plunger 110 has been withdrawn and actuation of switch assembly 84 has resulted from pressing together the first and second electrical contacts 92, 98 as hereinbefore described.

Referring now to FIG. 5, a circuit is illustrated showing the electrical connections between the electric power supply, the opener motor 43, and the solenoid assemblies 50, 52 in the preferred embodiment. For purposes of reference, the components of solenoid assembly 50 are distinguished from the components of solenoid assembly 52 by an "a" on the elements of assembly 50, and a "b" on those of assembly 52. For example, solenoid core 78 is denoted **78*a* on assembly 50 and 78*b* on assembly 52**.

The means for actuation of the solenoid assemblies includes a relay 130, such as relay number 1390P-2C-120A available from Guardian Electric Manufacturing Company, Chicago, Ill. The actuation of relay 130 is caused by application of electrical power to line 132, which is the line supplying power to the opener motor 43. This particular line normally supplies electrical power to the opener motor 43, and is selectively actuable by the user. In the Genie models SP-99, SP-129 and SP-229, previously described, this line 132 is of the color "orange," and is also denoted as the "up" connection. In other preferred embodiments (not shown) the solenoid cores **78*a*, may instead be electrically connected to a light (not shown) provided with the opener assembly 30. This light is normally actuated by the user each time the door is actuated in either direction and usually therein a delay time of several minutes directs which the light is actuated but the door is closed. In this embodiment (not shown) the operator motor circuit does not supply the power to actuate the solenoid cores 78*a,b***.

In the preferred embodiment of the present invention, application of electrical power to the line 132 causes actuation of the relay 130 which is symbolized by the closing of switch 134. When switch 134 is closed, electrical power is supplied to the solenoid cores **78*a,b* of each solenoid assembly 50, 52, therefore causing the plungers 110*a,b* to move in the direction indicated by the arrows. As the plungers 110*a,b* move in this direction, they make contact with first flexible arms 90*a,b*, pushing them upward so that electrical contact is made between the first and second electrical contacts 92*a,b* and 98*a,b***.

The opener motor 43 is electrically connected to a second electrical contact, for example contact **98*a*, advantageously by connecting the "black" wire, or the sole connection of the opener motor to AC neutral, to the second contact 98 of solenoid assembly 50. The first contact 92 of this solenoid 50 is electrically connected to the second contact 98 of the solenoid 52. The first contact 92 of the solenoid 52 is connected to AC neutral of the electric power supply 44. Because the sole connection of the motor 43 to AC neutral of power supply 44 is through this circuit, the opener motor 43 becomes operable only when the switches 84*a,b* (or, in other words, the two pair of contacts 92 and 98) of each solenoid assembly 50, 52** are closed. Other circuits (not shown) are known in the art, which may accomplish same or similar purposes, and therefore the present invention encompasses such circuits, as well as the described circuit. For example, the power supply connection to AC neutral may be reversed with the connection AC hot, with substantially no effect upon the operation of the circuit.

In summary then, the application of electrical power to actuate the opener motor 43 causes relay 134 to close, in turn actuating solenoid assemblies 50, 52. The plungers **110*a,b* move upward, closing the switches 84*a,b* which complete the connection of the opener motor to AC neutral of the electric power supply. In this manner, the garage door opener assembly 30 cannot operate until physically unlocked and, therefore protecting the opener assembly 30, the door frame 14, and the garage door 10 from the damage that could occur if the opener motor were actuated with either of the plungers 110*a*, or 110*b*** in the closed position.

In the preferred embodiment, the solenoid assemblies 50, 52 are affixed to each upper corner of the garage door frame 24, and the latch members 60, 62 are affixed in alignment thereto on the upper edge 26 of garage door 10. In this configuration, the plungers **110*a,b* are substantially not subject to unauthorized manipulation, due in part to the fact that there is substantially no clearance between the face of garage door 10, and the upper frame surface 24, in part to its height above the ground, and also because any force tending to pry apart the adjacent portions of the door 10 and the upper frame surface 24 increases the frictional force between either of the plungers 110*a,b* and the respective latch member 60,62**, thereby rendering it more difficult to manipulate the respective plunger.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An electromagnetic door lock apparatus for securing an overhead garage door, said electromagnetic door lock apparatus comprising:

an electrically actuated overhead garage door assembly, said assembly having an opener motor of the type selectively actionable for moving a garage door between a generally vertical closed position received within a door frame and a generally horizontal open position, said open position providing an access opening through the door frame;

a bracket for mounting on the door frame;

a solenoid core affixed to the bracket, said solenoid core having an inner core cavity;

a solenoid plunger received within a portion of said inner core cavity, said plunger being oriented so that it has a core end received within said solenoid core, and an opposite locking end, said plunger being selectively positionable with respect to said solenoid core, (i) to a locked position wherein said locking end of said core plunger is extended away from said solenoid, and (ii) to an unlocked position wherein said core end of said plunger is withdrawn within said solenoid core;

means for biasing said solenoid plunger in a direction away from said solenoid core and toward the locked position;

means responsive to the movement of said plunger for sensing the locked and the unlocked position of said plunger;

means operably connected to said sensing means for (i) rendering said garage door opener motor actuable only when said plunger is in the unlocked position, and (ii) preventing actuation of said opener motor when said plunger is in the locked position; and a latch member for mounting on the door, said latch member being affixed in a position such that the latch receives the locking end of said solenoid plunger in the locked position;

whereby said solenoid plunger secures the door in the closed position while said actuation prevention means precludes actuation of the opener motor in order to prevent the possibility of damage to the door opener assembly.

2. The electromagnetic door lock apparatus as recited in claim 1, wherein said biasing means comprises a spring engaging said plunger.

3. The electromagnetic door lock apparatus as recited in claim 1, wherein said actuation prevention means comprises a switch electrically connected to said garage door opener motor for selective actuation of said opener motor, and wherein said sensing means comprises a pin which is engageable with said core end of said plunger when said plunger is in the unlocked position to actuate said switch and said opener motor.

4. The electromagnetic door lock apparatus as recited in claim 3, wherein said pin extends into said inner core cavity of said solenoid core so that when said plunger is in the unlocked position, said pin contacts the core end of said plunger, and wherein said switch comprises a first and a second electrical contact, so that an electrical connection between said first and second electrical contacts is responsive to a movement of the pin whereby the electrical switch is mechanically actuated by the unlocked position of the plunger.

5. The electromagnetic door lock apparatus as recited in claim 4, wherein said switch has a rigid body affixed rigidly to said bracket, and said switch further comprises a first contact arm connected to said switch body and engaging said pin, said first arm mounting the first electrical contact, and said switch further comprising a second contact arm connected to said switch body, said second arm mounting said second electrical contact, the respective alignment of said first and the second arms being such that, in said plunger locked position, said first and second contacts are spaced apart, and, in said unlocked position, said first contact arm is moved by said pin's movement responsive to said plunger so that an electrical connection is made between the first and second electrical contacts.

6. The electromagnetic door lock apparatus as recited in claim 5, wherein said first contact arm is biased away from said second contact arm to separate said first and second electrical contacts when said plunger returns to said locked position.

7. The electromagnetic door lock apparatus as recited in claim 5, wherein the overhead garage door assembly further comprises an opener motor power supply connection and wherein said actuation prevention means comprises said first and second electrical contacts, said electrical contacts being operably connected to the opener motor power supply connection so that the opener motor is actuable only when contact is made between said first and second electrical contacts.

8. The electromagnetic door lock apparatus as recited in claim 1, comprising a first solenoid secured at an upper corner of the garage door frame above the garage door and a first latch mounted on the top upper corner of the garage door aligned so that a first plunger of said first solenoid is received by said first latch, and further comprising a second similar solenoid and second latch secured in the opposite upper corner in a similar manner and alignment, and wherein the means for electrically actuating the first solenoid is operably connected to the core of the second solenoid so that both solenoids must be simultaneously electrically actuated before said garage door will open in order to avoid damage to said door lock apparatus.

9. An electromagnetic door lock apparatus for securing an overhead garage door, said electromagnetic door lock apparatus comprising:

an electrically actuated overhead garage door assembly electrically connectable to an electric power supply, said assembly having an opener motor of the type selectively actuable for moving a garage door between a generally vertical closed position received within a door frame and a generally horizontal open position, said open position providing an access opening through the door frame;

a solenoid core for mounting adjacent said overhead garage door and being electrically connectable to said power supply, said core having an inner core cavity;

a solenoid plunger movable within said inner core cavity and responsive to the energized or de-energized condition of said core;

a lock actuated by said solenoid plunger and engageable with said door to selectively lock and unlock said door;

a sensor for sensing the locked or unlocked condition of said lock; and a switch actuated by said sensor and electrically connected to said motor, said switch supplying electrical energy to said motor for opening said garage door only when said sensor indicates that said lock is in the unlocked position, thus avoiding damage to the motor, door, or electromagnetic door lock apparatus.

10. The electromagnetic door lock apparatus as recited in claim 9, wherein said power supply is deactivated when said lock is in the locked position, and is activated when said lock is in the unlocked position to supply electrical energy to said motor.

11. The electromagnetic door lock apparatus as recited in claim 9, wherein said switch comprises:

a pair of contacts, one of said contacts being mounted on a flexible arm;

wherein said sensor comprises a pin slidable within said inner core cavity of said solenoid core, said pin being actuated by and engageable with said solenoid plunger only when said lock is in the unlocked position; and said pin, when actuated, engaging said flexible arm to bring said contacts into electrical contact to supply electrical energy to said motor, thereby permitting the opening of the garage door only when the lock is unlocked.

12. The electromagnetic door lock apparatus as recited in claim 9, wherein said solenoid plunger comprises a non-magnetic end.

13. A method for opening an electrically actuated overhead garage door which is in a generally vertical closed position and in a locked condition by means of an electrically actuated solenoid assembly, said solenoid assembly comprising a plunger actuated by the core of said solenoid and a user switch for providing electrical power to said solenoid assembly, the lock for said overhead garage door being electrically connected to said solenoid assembly, the method comprising the steps of:

a. activating the user switch so that electrical power is applied to said solenoid assembly;

b. actuating the solenoid plunger for withdrawing the door lock from the locked position of the overhead garage door;

c. detecting the position of the lock to ensure that it is in the locked position; and d. actuating a detector switch to connect the electrical power supply to the opener motor for the overhead garage door;

whereby the opener motor cannot be actuated when the detector switch is not actuated, to prevent application of an opening force against a closed garage door lock, thereby preventing damage to the overhead garage door and also preventing the solenoid plunger from binding.

* * * * *